US006267378B1

(12) United States Patent
Kanbar

(10) Patent No.: US 6,267,378 B1
(45) Date of Patent: Jul. 31, 2001

(54) PIECE-BOUNCING GAME

(76) Inventor: Maurice S. Kanbar, 2282 Van Ness Ave., San Francisco, CA (US) 94109-1426

( * ) Notice: Subject to any disclaimer, the term of this patent is extended or adjusted under 35 U.S.C. 154(b) by 0 days.

(21) Appl. No.: 09/478,070

(22) Filed: Jan. 3, 2000

(51) Int. Cl.[7] ..... A63B 67/00
(52) U.S. Cl. ..... 273/342; 273/353
(58) Field of Search ..... 273/126 R, 353, 273/348, 317, 342

(56) References Cited

U.S. PATENT DOCUMENTS

| | | | | |
|---|---|---|---|---|
| 453,480 | * | 6/1891 | Hoyt | 273/353 |
| 464,098 | * | 12/1891 | Harr | 273/353 |
| 611,915 | * | 10/1898 | Klauder | 273/353 |
| 1,217,908 | * | 3/1917 | Brewer et al. | 273/353 |
| 5,201,526 | * | 4/1993 | Ketcham, Jr. | 273/342 |
| 5,423,552 | * | 6/1995 | English | 273/342 |
| 5,443,269 | * | 8/1995 | Loritz | 273/241 |
| 5,566,948 | * | 10/1996 | Kidd | 273/342 |
| 5,619,815 | * | 4/1997 | Greene | 40/661.05 |

FOREIGN PATENT DOCUMENTS

| | | | | |
|---|---|---|---|---|
| 1077712 | * | 8/1967 | (GB) | 273/353 |

* cited by examiner

*Primary Examiner*—Raleigh W. Chiu
(74) *Attorney, Agent, or Firm*—Hopgood, Calimafde, Judlowe & Mondolino

(57) ABSTRACT

A piece-bouncing game wherein each player seeks to propel a play piece to make it bounce on a playing surface and then travel in a trajectory which causes the piece to land on a flat platform. The player scores a point in the game only if the piece lands and remains on the platform. The game consists of a cylindrical dish having a flat base on which is anchored an array of plugs, the play pieces being mountable on the plugs. Each play piece is formed by a circular collar having a membrane lying across its central plane and provided with a center hole. In the storage mode of the game, in which the play pieces are stored within the dish, each plug is plugged into the center hole of the piece mounted thereon. In the active mode of the game, the pieces are taken off the plugs and the dish is inverted and placed on the playing surface whereby the base of the dish is then raised above the playing surface to serve as the platform.

7 Claims, 2 Drawing Sheets

PIECE-BOUNCING GAME

BACKGROUND OF INVENTION

1. Field of Invention

This invention relates generally to games in which each player seeks to propel a play piece toward a goal by bouncing the piece on a playing surface, and more particularly to a game of this type in which the play piece is an annular collar that only bounces when an edge of the collar strikes the playing surface at an acute angle thereto.

2. Status of Prior Art

It is known to provide a game in which a player seeks to propel a play piece toward a game by bouncing the piece on a playing surface, so that the piece then travels toward a goal or target.

In a simple version of this game, the play pieces are small rubber balls, and the target or goal is a large open can placed on the floor. The player is required from a home base position to hurl this ball so that it bounces on the floor and then travels in a trajectory leading into the can. In this game, the player scores a point only if the ball falls into the can and remains therein. Should the ball not fall into the can or should it fall into the can and then bounce out, the player does not score a point.

A piece-bouncing game is more challenging than a game in which a player is required to toss a ball or other play piece into a raised receptacle, such as a basketball hoop. It is far easier for a player to judge how best to throw his play piece to reach and fall into the hoop, than for a player to figure out where to bounce his play piece and how hard to throw it so that the resultant trajectory will lead the piece toward its goal.

On the other hand, if the bouncing pieces are spherical balls, a player can usually predict its trajectory it will take when the ball strikes a planar playing surface, for the angle of bounce is exactly the opposite of the incoming angle at which the ball strikes the playing surface. Hence a bouncing piece game using spherical play pieces cannot sustain the interest of players who find it too easy to score points.

Moreover, a bouncing ball game requires a fairly large room in which to play the game, for to bounce the ball on a floor, one must place the goal to receive the ball a fairly long distance from the point of bounce. A bouncing piece game in accordance with the invention which uses non-spherical play pieces requires little space to play, and therefore can use a table or a disk as the playing surface.

SUMMARY OF INVENTION

In view of the foregoing, the main object of this invention is to provide a piece-bouncing game in which each player seeks to propel a non-spherical play piece to make it bounce off a planar playing surface and then travel in a trajectory causing the piece to land and remain on a platform.

The advantage of a game of this type over a bouncing-piece game using ball-like play pieces is that it can be played on a table or desk, or in a small region on the floor, for the game takes relatively little room to play.

More particularly, an object of this invention is to provide a game of the above type in which each play piece is in the form of a circular collar which bounces only when an edge of the collar strikes the playing surface at an acute angle thereto. Consequently, for a player to succeed, he must acquire the skill necessary to launch the play piece with a proper degree of force and at an angle at which the resultant bounce will cause the play piece to land on the platform.

A significant feature of a game in accordance with the invention is that it includes a dish which provides the platform and also acts as a storage bin for the several play pieces, so that no play piece is lost.

Briefly stated, these objects are attained by a piece-bouncing game wherein each player seeks to propel a play piece to make it bounce on a playing surface and then travel in a trajectory which causes the piece to land on a flat platform. The player scores a point in the game only if the piece lands and remains on the platform.

The game consists of a cylinder having a flat base on which is anchored an array of plugs, the play pieces being mountable on the plugs. Each play piece is formed by a circular collar having a membrane lying across its central plane and provided with a center hole. In the storage mode of the game, in which the pieces are stored within the dish, each plug is plugged into the center hole of the piece mounted thereon. In the active mode of the game, the pieces are taken off the plugs and the dish is then inverted and placed on the playing surface whereby the base of the dish is then raised above the playing surface to serve as the platform.

BRIEF DESCRIPTION OF DRAWINGS

For a better understanding of the invention as well as other objects and further features thereof, reference is made to the following detailed description to be read in conjunction with the accompanying drawings, wherein.

DETAILED DESCRIPTION OF INVENTION

A bouncing-piece game in accordance with the invention makes use of four identical non-spherical play pieces 10 and a cylindrical dish 11 having an annular side wall 12 and a flat, circular base 13. The play pieces and the dish are molded of synthetic plastic material, such as PVC, polypropylene or polyethylene.

Figure 1:
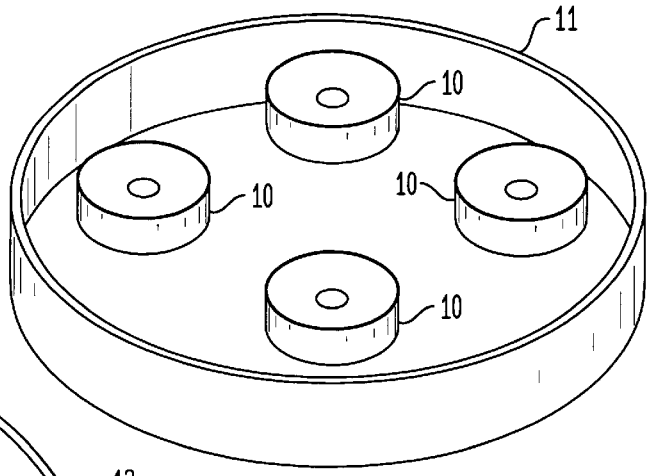
FIG. 1 is a perspective view of a game in accordance with the invention in its storage mode.
Figure 2:
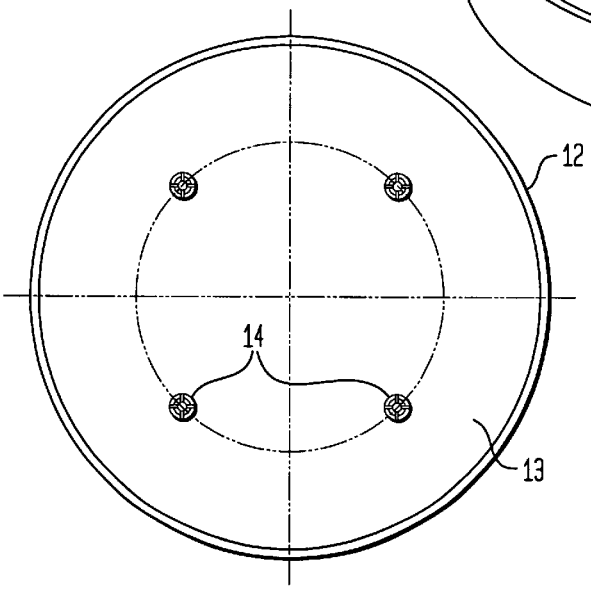
FIG. 2 is a plan view of the cylindrical dish included in the game.
Figure 3:
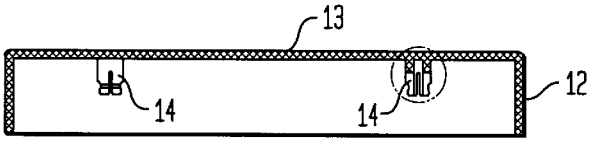
FIG. 3 is a section taken through the dish in an inverted state.

Anchored on the inner face of base 13 of dish 11 is an array of four plugs 14 which are placed 90 degree apart on a circle concentric with the annular wall 12 of the dish. Each plug, as best seen in FIGS. 1 and 3, is provided with a cruciform slot C that divides the plug into four flexible tines T. Adjacent the tip of each tine is a notch N which acts as a latch, as will later be explained.

Figure 4:
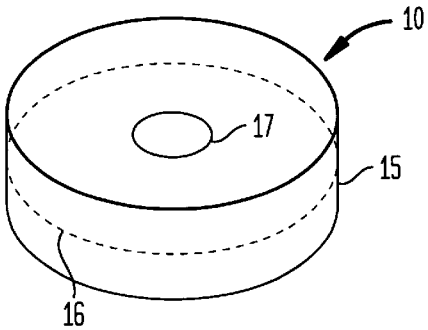
FIG. 4 is a perspective view of one of the play pieces.
Figure 5:
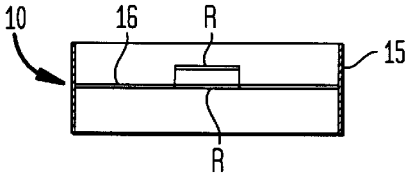
FIG. 5 in a diametrical section taken through the play piece.
Figure 6:
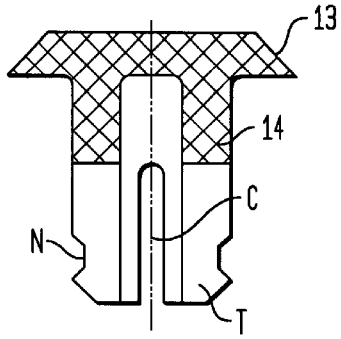
FIG. 6 is a section taken through one of the plugs on which a play piece is mounted.

As shown in FIGS. 4 and 5, each play piece 10 is formed by an open-ended cylindrical collar 15 within whose at its central plane lies a membrane 16 provided with a center hole 17. The opposing ends of hole 17 are each bordered by a slightly raised circular rim R.

The diameter of center hole 17 of play piece 10 is slightly smaller than the normal diameter of plug 14 on which the play piece is mountable. Hence when the play piece is being mounted by pressing it onto plug 14, the flexible tines of the plug are then forced by the center hole to flex inwardly to permit the plug to enter the hole. When the rims R of the hole fall into notches N on the tines T, the plug is then latched and the piece is locked in place, in which state the dish acts as a storage bin for the four play pieces. Hence shown in FIG. 1 is the game in its storage mode, there then being no loose play pieces. But it takes little effort to pull the play pieces off their plugs so that they can be played with.

In an actual embodiment of the game, the dish has a diameter of six inches and a depth of one inch, while the play pieces each have a diameter of 1⅜ inches a height of ⅝ inches. But the invention is not limited to these dimensions, nor to just four play pieces. In a larger version of the game, there may be six or more play pieces.

Figure 7:
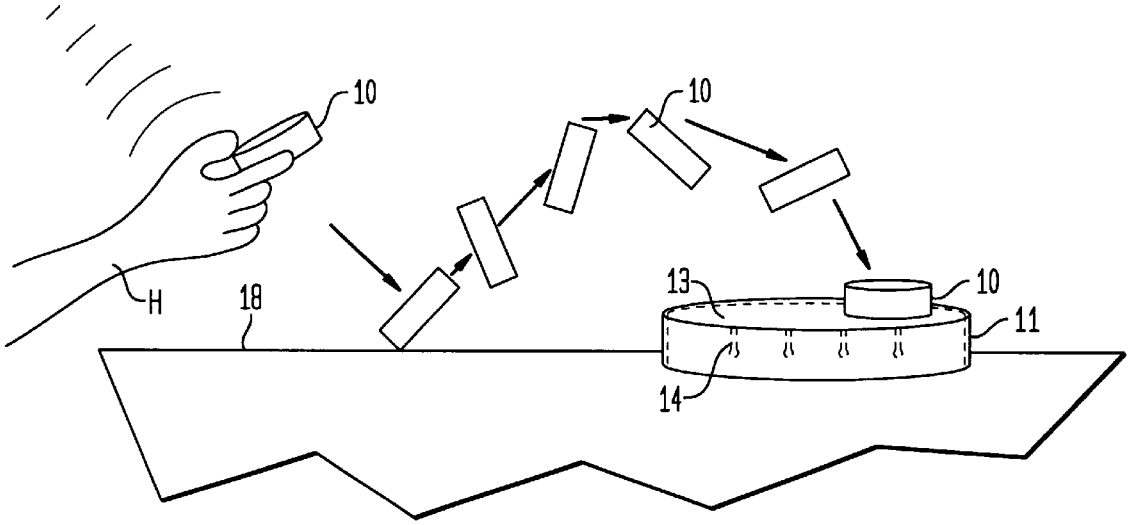
FIG. 7 shows the game in its active mode.

FIG. 7 illustrates the game in its active or play mode in which play pieces 10 are removed from dish 11 and the dish is then inverted and placed on a planar playing surface 18 whereby the base 13 which is now raised above the playing surface, functions as a platform.

This playing surface may be a table top, a desk, or any other piece of furniture having a flat top. It requires little space to play this game and there is no need therefore to play the game on the floor of a room, although one may do so.

In play, a player grasps his play 10 piece in his hand H and launches the play piece which has the geometry of an open-ended collar so as to cause it to strike playing surface 18 at an acute angle thereto so that only a point on an edge of either circular edge of the collar that strikes this surface. As a result of this point contact impingement with the playing surface, the playing piece bounces to travel from the point of contact in a trajectory causing the play piece to land on platform 13 and remain thereon.

Whether play piece 10 actually lands on the platform rather than on the playing surface adjacent the platform depends on the force and direction of the throw. A player who has just begun to play this game is likely to miss the platform. It is only with repeated throws that a player acquires the skill to bounce a play piece so as to cause it to land on the platform.

In the embodiment of the game illustrated herein, there are four play pieces, hence there can be four players. The rules of the game are such that the first player to reach a predetermined high score is the winner.

Thus the game rules may be such that a player is awarded a single point each time his play piece lands on the platform and stays thereon. But if the play piece falls off the platform, the player does not gain this point. In practice, each play piece may be marked on one side with the number 1 and on the opposite side with number 2. If this piece lands on the platform so as to expose number 1, the player gains one point, but if number 2 is exposed, he gains two points. And if the collar shaped piece lands on its annular wall and stays on the platform without rolling off, the player then gains 3 points. Also if when a piece lands on the platform and in doing so knocks off a piece already landed thereon by a competing player, this player loses a point.

However, the rules of the game are not limited to those given above, and other rules may be improvised by the players.

While there has been disclosed a piece-bouncing game in accordance with the invention, it is to be understood that many changes may be made therein without departing from the spirit of the invention.

I claim:

1. A bouncing piece game comprising:

A. a plurality of play pieces, one for each player, each play piece being formed by cylindrical collar having a circular edge on either end thereof, and a membrane spanning the opening formed by the collar; and B. A platform placeable on a playing surface and raised thereabove, whereby a player who throws his play piece so that it strikes the playing surface and bounces to then travel in trajectory causing the play piece to land on the platform then scores a point.

2. A game as set forth in claim 1, in which the player pieces and the platform are molded of synthetic plastic material.

3. A game as set forth in claim 1 in which the platform is the base of a dish having an annular wall, which dish, when inverted on the playing surface, presents the base as the platform.

4. A game as set forth in claim 2, in which anchored on the inner face of the base of the dish are a plurality of plugs on which the play pieces are mountable.

5. A game as set forth in claim 4, wherein the membrane has a center hole therein to receive one of said plugs, thereby mounting the play piece on the plug.

6. A game as set forth in claim 5, in which each of said plugs is slotted to create flexible tines which are inwardly flexed when the plug is received in the hole of the membrane.

7. A game as set forth in claim 5 in which said plugs form an array of four plugs lying on a circle concentric with the annular wall.

* * * * *